US009242187B2

(12) United States Patent
Ford

(10) Patent No.: US 9,242,187 B2
(45) Date of Patent: Jan. 26, 2016

(54) TRACK AND FIELD STARTING BLOCK ANCHOR

(75) Inventor: Michael C. Ford, Fox Point, WI (US)

(73) Assignee: Michael C. Ford, Fox Point, WI (US)

( * ) Notice: Subject to any disclaimer, the term of this patent is extended or adjusted under 35 U.S.C. 154(b) by 3 days.

(21) Appl. No.: 13/111,720

(22) Filed: May 19, 2011

(65) Prior Publication Data

US 2011/0287897 A1 Nov. 24, 2011

Related U.S. Application Data

(60) Provisional application No. 61/346,269, filed on May 19, 2010, provisional application No. 61/431,311, filed on Jan. 10, 2011.

(51) Int. Cl.
*A63K 3/02* (2006.01)

(52) U.S. Cl.
CPC ..... *A63K 3/023* (2013.01); *A63B 2225/05* (2013.01)

(58) Field of Classification Search
CPC ..... A63K 3/02; A63K 3/023; F16B 47/00; Y10T 279/11; B25B 11/005; H01L 21/6838; B25J 15/0616–15/0691; A63B 2220/30
USPC ..... 482/14, 19, 52, 54, 66, 70, 74, 79, 80, 482/117, 148; 248/205.5, 205.6, 248/206.1–206.3, 309.3, 363, 362, 537, 683
See application file for complete search history.

(56) References Cited

U.S. PATENT DOCUMENTS

| | | | | |
|---|---|---|---|---|
| 1,709,832 | A | 4/1929 | Barron | |
| 1,793,898 | A | 2/1931 | Barron | |
| 2,311,525 | A * | 2/1943 | Ebbs | 269/21 |
| 2,945,242 | A | 7/1960 | Heiden | |
| 3,401,931 | A | 9/1968 | McCafferty | |
| 3,608,897 | A * | 9/1971 | Ross | 482/19 |
| 3,655,193 | A | 4/1972 | Jones | |
| 3,724,843 | A * | 4/1973 | Fichter et al. | 482/8 |
| 4,419,989 | A * | 12/1983 | Herbold | 606/242 |
| 4,561,650 | A | 12/1985 | Newton, Jr. | |
| 4,836,482 | A * | 6/1989 | Sokol | 248/206.3 |
| 4,880,230 | A * | 11/1989 | Cook | 482/113 |
| 5,779,205 | A * | 7/1998 | Ching | B60R 11/0241 248/205.8 |
| 5,893,543 | A * | 4/1999 | Emery et al. | 248/205.5 |
| 5,894,705 | A * | 4/1999 | Sutton | 52/747.1 |
| 5,897,417 | A * | 4/1999 | Grey | 446/125 |
| 5,913,754 | A * | 6/1999 | Lochbaum | 482/111 |
| 6,039,371 | A * | 3/2000 | Smith | 294/8.6 |
| 7,021,593 | B1 * | 4/2006 | Fan | 248/206.2 |
| 7,134,968 | B1 * | 11/2006 | Pryor | 473/257 |
| 7,156,775 | B1 | 1/2007 | Watry et al. | |
| 7,387,284 | B2 * | 6/2008 | Chang | 248/206.5 |
| 7,441,734 | B2 * | 10/2008 | Liou | 248/205.5 |
| 2007/0087900 | A1 * | 4/2007 | Christensen | 482/19 |
| 2007/0200037 | A1 * | 8/2007 | Nan | 248/205.5 |
| 2008/0093518 | A1 * | 4/2008 | Roth | A47K 3/38 248/207 |
| 2009/0071992 | A1 * | 3/2009 | Franz | 224/420 |
| 2009/0090757 | A1 * | 4/2009 | Kim et al. | 224/559 |
| 2009/0166497 | A1 * | 7/2009 | Carnevali | 248/309.4 |

FOREIGN PATENT DOCUMENTS

| | | | |
|---|---|---|---|
| GB | 2199503 A * | 7/1988 | |

* cited by examiner

*Primary Examiner* — Loan H Tranh
*Assistant Examiner* — Gregory Winter
(74) *Attorney, Agent, or Firm* — IpHorgan Ltd.

(57) ABSTRACT

A new and useful improvement in starting blocks and starting block anchoring devices for use at the line of start of a track either indoors or outdoors. The inventive starting block anchor is comprised of a vacuum suction device operatively and releasably attaches to an interface that also operatively and releasably attaches to a track and field starting block of various configurations.

18 Claims, 7 Drawing Sheets

TRACK AND FIELD STARTING BLOCK ANCHOR

CROSS-REFERENCE TO RELATED APPLICATIONS

This application claims the benefit of U.S. Provisional Patent Application Ser. Nos. 61/346,269, filed May 19, 2010, and 61/431,311, filed Jan. 10, 2011, the contents of both applications of which are incorporated by reference herein.

FIELD OF THE INVENTION

This invention relates to track and field equipment and more particularly to starting blocks for track runners.

BACKGROUND OF THE INVENTION

Starting blocks used in the indoor field house equipped with an official or practice surface generally utilize pins placed in holes in the track. As the holes wear the pins become loose and the blocks are subject to significant movement when a runner pushes off at the start of a race. It is typical for an Official Starter to instruct the next heat of runners to stand on the block of the current heat to reduce movement. The starting block anchor is intended to adhere to the surface thus not requiring the assistance of other contestants at the start of a race.

Some running surfaces are not equipped with holes to receive the starting block pins and therefore pose a different set of issues. Surfaces that are used for practice in a school or institution that is not fortunate enough to have a field house generally are multipurpose in nature (gym, halls etc.) and do not have holes to receive block pins. In this case a rug is sometimes utilized to reduce slipping. The blocks are required to be positioned against a wall, have a person stand on the blocks or a combination to keep the blocks in place. Obviously, this can be a problem if the above materials are not available or a person is not available to assist in holding the blocks.

The present invention relates to certain new and useful improvement in starting blocks, which, like prior art adaptations, are advocated and adapted for use at the customary line of start of a track either indoors or outdoors.

SUMMARY OF THE INVENTION

One general object of this invention is to provide a solution to anchor traditional track and field starting blocks to an indoor smooth surface. The invention provides a bracket to connect manufactured starting blocks to a suction device that is temporarily attached to a smooth surface such as a gym floor or school hallway. A key purpose of the starting block anchor is to prevent the starting blocks from slipping when the runner pushes off by applying a backward force with their feet on the blocks in a traditional sprinting start. The invention generally comprises an anchor consisting of a vacuum suction device that engages an interface or docking device that, in turn, engages the starting blocks. The interface or docking device releasably engages both the anchor and starting blocks for ease of transport, storage and adjustment of the equipment.

In one embodiment, the invention comprises a device for anchoring a starting block to a surface comprising: (a) a stabilizing bracket and a first locking assembly adapted releasably engage the bracket member and the starting block; and (b) a suction assembly hingedly and releasably attached to the bracket member, the suction member configured to releasably and securely engage the surface to which the starting block is to be anchored. In another embodiment, the invention comprises a device for anchoring a starting block to a surface comprising an interface have a first end adapted to releasably engage the starting block, and a second end adapted to releasably engage a suction assembly, the suction assembly adapted to releasably and securely engage the surface to which the starting block is to be anchored, the second end further adapted to provide for axial and rotational adjustment of the second end of the interface.

DETAILED DESCRIPTION OF THE INVENTION AND DRAWINGS

One key element of the present invention is the universal use of the starting block anchor 32 with many types of commercially available starting blocks without permanently modifying them to the extent they are no longer useful in their original purpose. Each component of the starting block anchor 32 is attachable and removable for ease of assembly, storage, and use of the starting block on a surface set up to securely receive the starting block.

Figure 1:
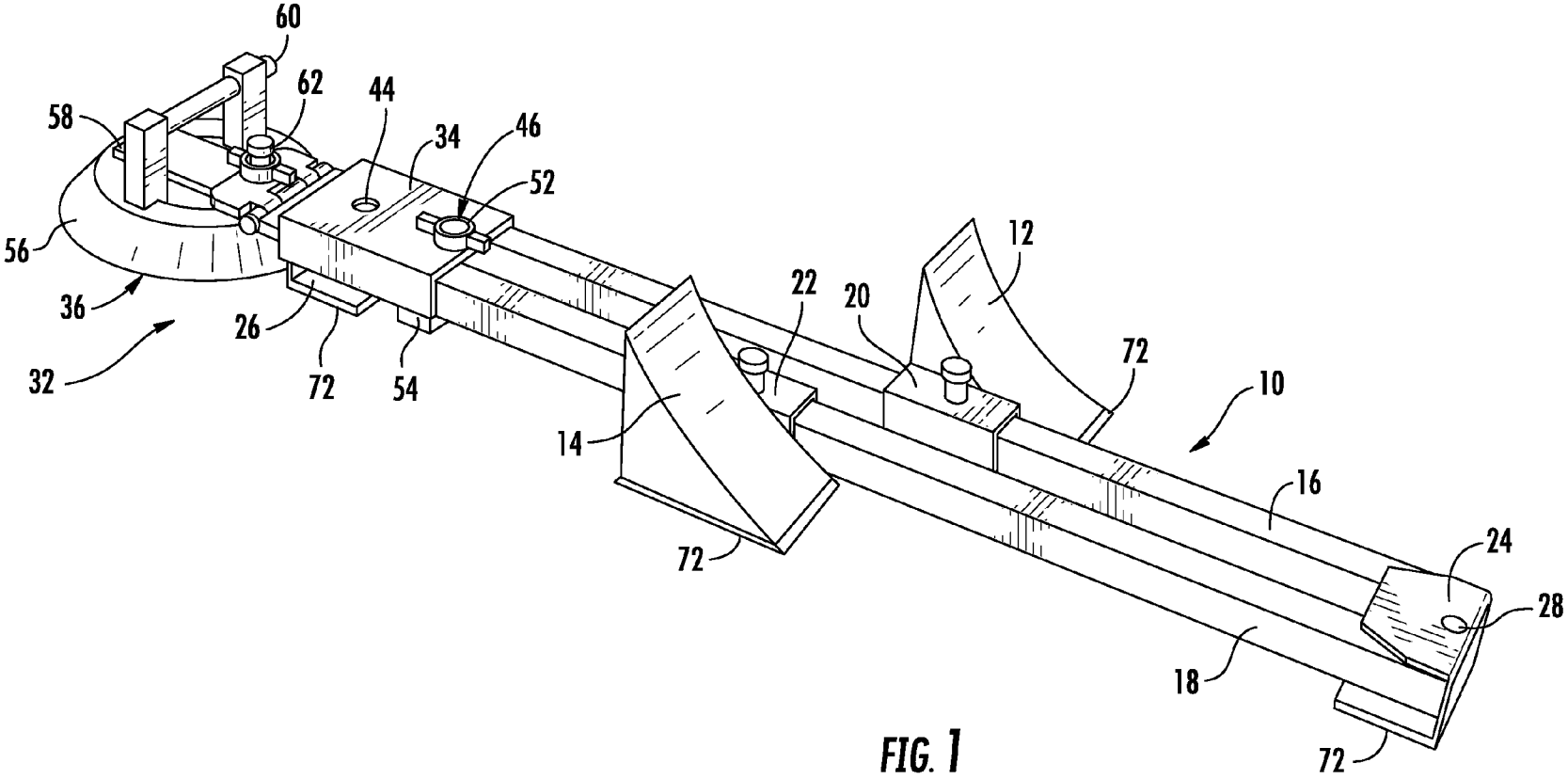
FIG. 1 shows a perspective view of the present inventive starter block and mounting device.
Figure 2:
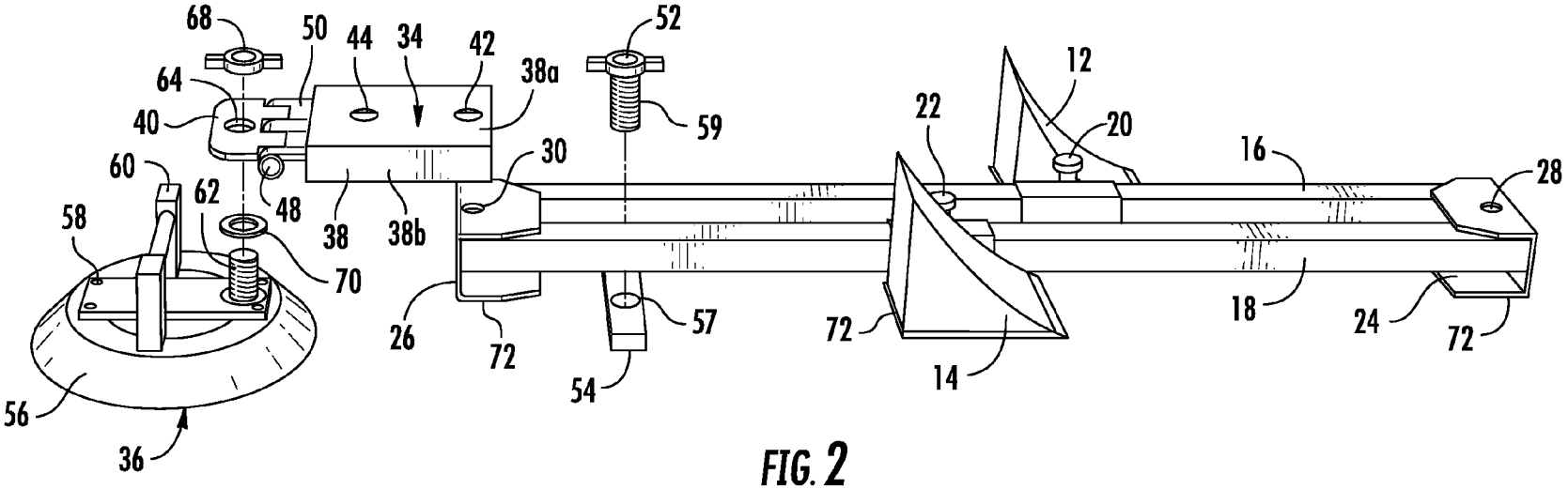
FIG. 2 shows perspective views of the components of the present inventive starter block and mounting device of FIG. 1.

FIGS. 1-2 show a typical track and field starting block 10 used in connection with a first embodiment of the present invention. The typical track and field starting block 10 generally comprises a first and second foot pedal 12, 14 attached to a central rail or rails 16, 18. The pedals 12, 14 are configured to travel the length of the rails, to rotate to a desired foot angle, and to lock into place by means of the locking mechanism 20, 22 at a desired position enabling the runner to set up a "custom" foot position to start a race. A front and rear support member 24, 26 attach to the rails 16, 18 to support the starting block 10 in ordinary use. Bores 28, 30 in the support members 24, 26 receive pins (not shown) for securing the starting block 10 to a track surface or other surface including receptacles for receiving the pins.

The starting block anchor 32 comprises a stabilizing member comprising a stabilizing plate 34 and suction assembly 36 rotatably or pivotally attached to the stabilizing plate 34. The stabilizing plate 34 comprises a horizontal stabilizing portion 38 *a*, and vertical stabilizing portions 38*b*, and bracket member 40 hingedly attached to horizontal stabilizing portion 38 *a*. It is contemplated that the horizontal and vertical stabilizing portions 38 *a*, 38 *b* are dimensioned to securely engage the central rails 16, 18 of the starting block 10 and to prevent significant rotation of the starting block 10 when the stabilizing plate 34 is engaged thereto. In the event that extra space or a gap is present, it is contemplated that the use of shims (not shown) can be utilized to account for the extra space and to create a secure and tight interface between these components. The stabilizing plate further comprises a first bore 42 that is part of a locking assembly 46 for securing the stabilizing plate 34 and starting block anchor 32 to the starting block 10 and a second bore 44 that corresponds to the bore 30 in the rear support member 26 when the stabilizing plate 34 is in place. The bracket member 40 is hingedly attached to the body member 38 via hinge pin 48 and hinge bracket 50.

The locking assembly 46 comprises a threaded winged nut 52 and locking bar 54 having a threaded bore 57 for receiving the threaded end 59 of the winged nut 52. The threaded end 59 is selected to have a diameter corresponding to the diameter of the first bore 42 in the stabilizing plate 34. In the embodiment of the present invention shown in FIGS. 1 and 2, the threaded end 59 inserts through the space present between the rails 16, 18 of the starter block 10 and then interfaces with the locking bar 54. For faster disassembly, stabilizing plate 34 can be removed from the starting blocks by loosening the winged nut 52 and rotating the locking bar 54 to insert between the rails 16, 18. This allows removal and assembly without completely disassembling the locking assembly each time components are separated.

The suction assembly 36 comprises a suction device 56, preferably a suction cup, mounted to a bracket assembly 58 that releasably engages the bracket member 40 of the stabilizing plate 34. The bracket assembly 58 comprises a pump 60 for creating a vacuum to secure the suction device 56 to a desired surface. Bracket assembly 58 further includes threaded bolt 62 which extends from the bracket assembly 58 and is configured to be received by a bore 64 in the bracket member 40 of the stabilizing plate 34. The threaded bolt 62 is preferably welded to the bracket assembly 58. It is contemplated that the pump 60 can be a manual cylindrical pump or, as dictated by complex circumstances such as an uneven surface, a powered pump. A winged nut 68 receives the end of the threaded bolt 62 that extends through the bore 64 to releasably secure the suction assembly 36 to the stabilizing plate 34. One or more spacers 70 may be placed on the threaded bolt 62 before it is received by the bore 64 to account for any gaps between the bracket 40 of the stabilizing bracket 34 and bracket assembly 58 of the suction device assembly 36.

As seen in FIGS. 1 and 2, the first and second pedals 12, 14 and front and rear supports 24, 26 also include removable rubber feet 72. These rubber feet 72 serve as additional friction points to keep the starting block 10 from slipping as well as protection from marring the floor surface.

The configuration, interface and assembly of the stabilizing bracket 34 and suction device assembly 36 exhibit a number of benefits of the present invention. The hinged engagement of the suction device assembly 36 to the stabilizing bracket 34 in connection with the incorporation of an interchangeable spacer 70, or multiple spacers, results in a self-leveling device that can account for a floor that is not level over the surface area required for the starting block 10. The ability to disengage the stabilizing bracket 34 from the suction device assembly 36 enables the stabilizing bracket to remain in place on the starting block 10 even when the starting block anchor 32 is not in use.

In operation, the surface immediately behind where the starting block is intended to be place is cleaned and the anchor 32 is placed on the cleaned surface with the threaded bolt 62 in the direction the runner is intended to run. The pump 60 is utilized to create a vacuum seal between the suction device 56 and floor. The stabilizing bracket 34 is attached to the starting block 10 by aligning the bore 44 in the stabilizing bracket 34 with the bore 30 in the rear support 26 of the starting block and engaging the locking assembly 46 to secure these components together. The bore 64 of the bracket member 40 is aligned with the threaded bolt 62 of the suction device assembly 36 and the winged nut 68 is threaded onto the bolt 62 to secure the suction device assembly 36 and stabilizing bracket 34. The starting block 10 is now securely engaged to the floor. It is to be understood that the steps articulated herein can be accomplished in various order without deviating from the desired result.

In another embodiment of the present invention a starting block anchor is configured to engage a starting block comprising a single central rail, as opposed to the multi-rail starting block shown in FIGS. 1 and 2. The general principles embodied in the first preferred embodiment described above are also found in this embodiment. In the present embodiment a first locking assembly is offset with respect to a center line on the horizontal stabilizing portion to enable the stabilizing plate to be centered over the central rail. A second locking assembly may be incorporated, offset to the opposite side of a center line on the horizontal stabilizing portion to further engage the central rail. Shims may be used as required to account for any space present between the vertical stabilizing portions and the central rail.

Figure 3:
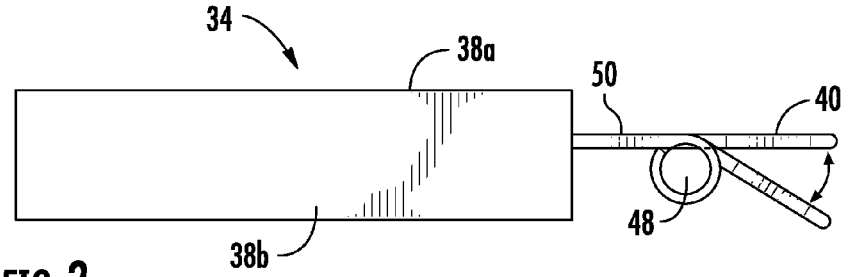
FIG. 3 shows a side elevation view of a component of the present inventive starter block and mounting device of FIG. 1.
Figure 4:
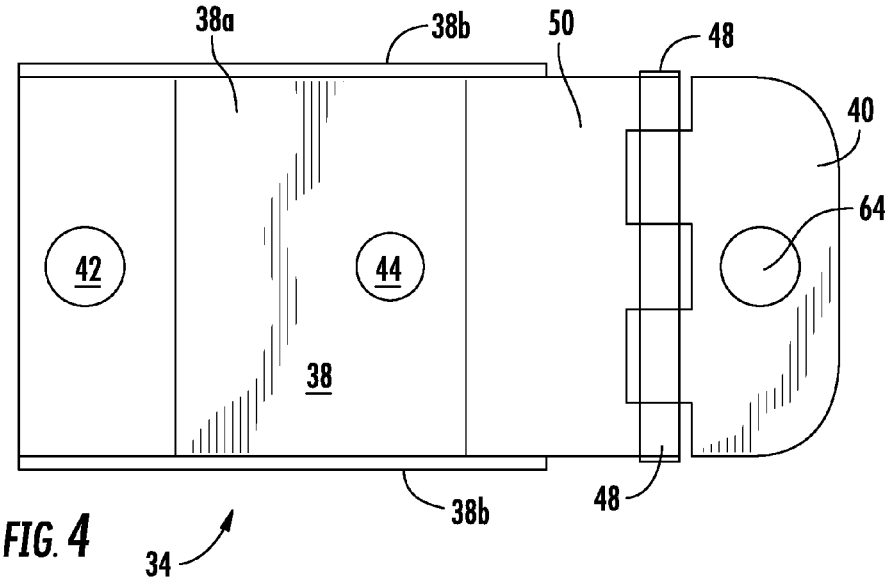
FIG. 4 shows a bottom plan view of a component of the present inventive starter block and mounting device of FIG. 1.
Figure 5:
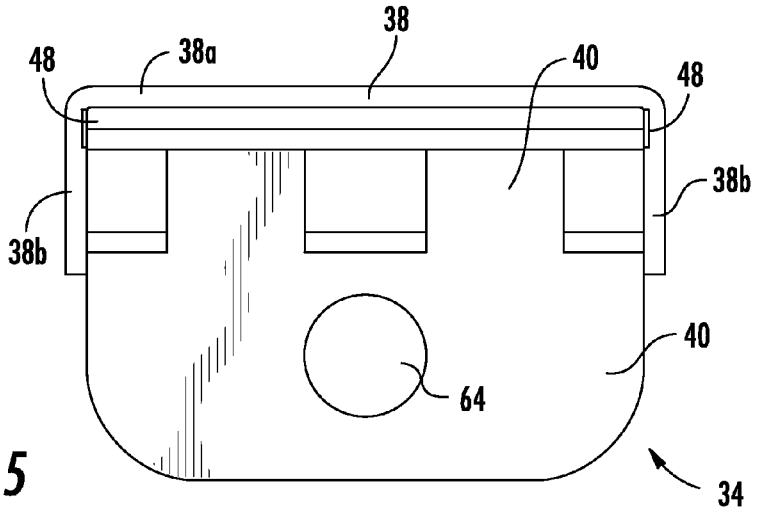
FIG. 5 shows a side elevation view of the component shown in FIG. 4.

FIGS. 3-5 shows an additional view of the stabilizing bracket 34 of the present invention and demonstrate the variable positioning of the bracket member 40 rotated about hinge pin 48.

FIGS. 6-9 show yet another embodiment of the present invention. Whenever possible like reference numbers and element/component names from the previously described embodiments will be adopted in the describing the present embodiment. In this embodiment a stabilizing member comprising an interface assembly 100 operatively connects the starting block 10 (only the starting block rails are shown in these figures; the actual blocks that contact the runner's shoes are not shown in these figures) and anchor 32, comprising a suction device assembly 36 having a suction device 56, preferably a suction cup, and suction device bracket assembly 124. The interface assembly 100 comprises a suitably elongated connecter member 102, such as a rod or shaft, with a first end, the starting block engagement portion, that releasably connects with the starting block 10 and a second end, the suction device assembly engagement portion, that includes a an axial rotation mechanism 114 that enables a rotatable connection with anchor 32. Head piece 104 provides the connection between the connector member 102 and starting block 10.

Figure 7:
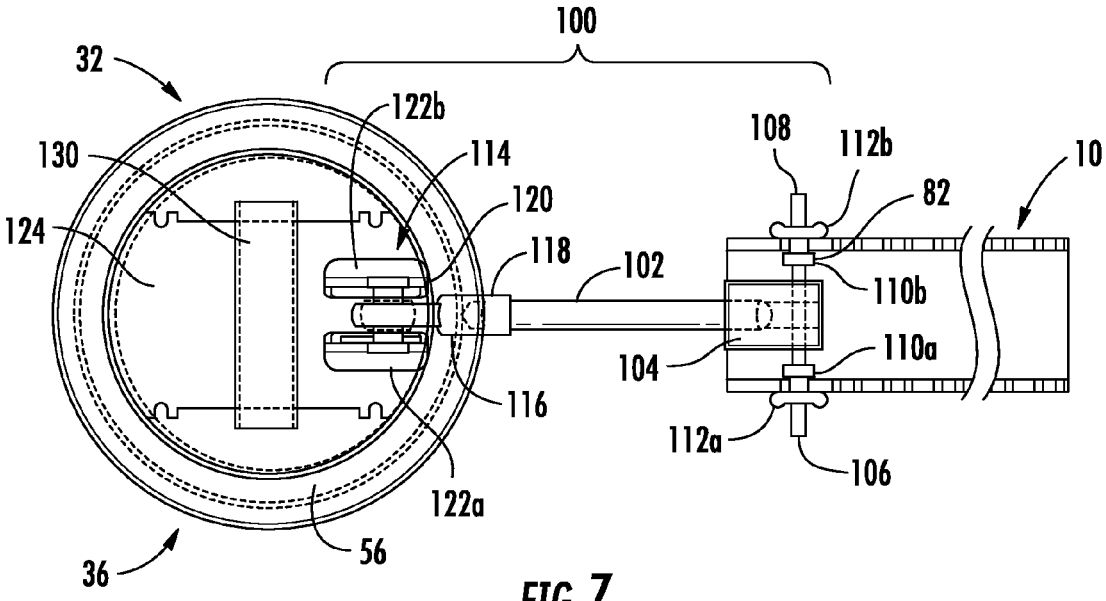
FIG. 7 shows a top plan view of another embodiment of the present inventive starter block and mounting device of FIG. 6.
Figure 8:
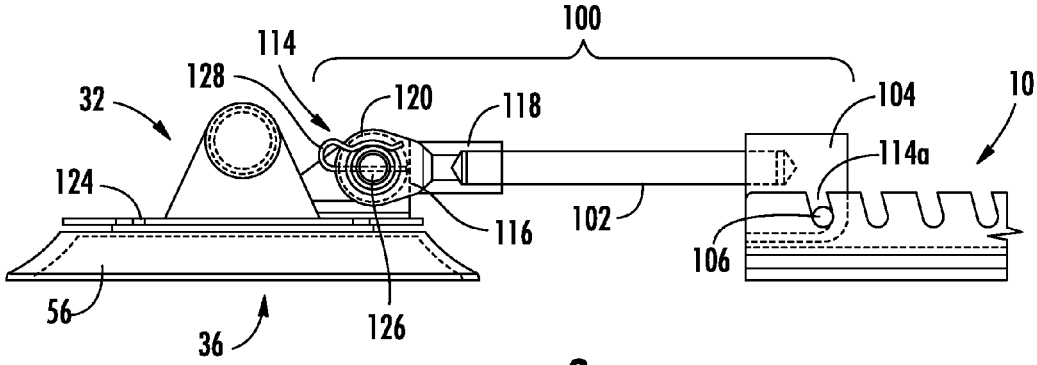
FIG. 8 shows a side elevation view of another embodiment of the present inventive starter block and mounting device of FIG. 6.
Figure 9:
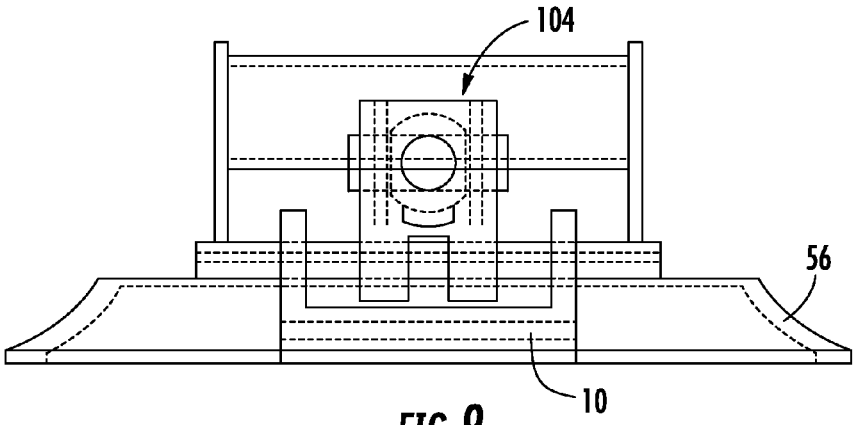
FIG. 9 shows a front elevation view of another embodiment of the present inventive starter block and mounting device of FIG. 6.

In the present embodiment, head piece 104 includes a first and second axle 106, 108, preferably threaded, used to secure the head piece 104 to a variety of slotted-style starting blocks. As seen in FIG. 7, the use of jam nuts 110*a, b* and wing nuts 112*a, b* can be used to secure the axles 106, 108 into corresponding slots 114 *a, b* on the starting block 10. With this arrangement, the head unit 104 can be used with the starting blocks having slots spaced apart at various widths. It is understood that the head piece 104 described herein is exemplary in nature can be reconfigured to be used with the starting block shown in FIGS. 1-5 without falling outside the scope of the present invention.

At the second end of the connector member 102 is an axial rotation mechanism 114 that enables multi-axial, automatic leveling of the starting block 10 with respect to the anchor 32.

Figure 6:
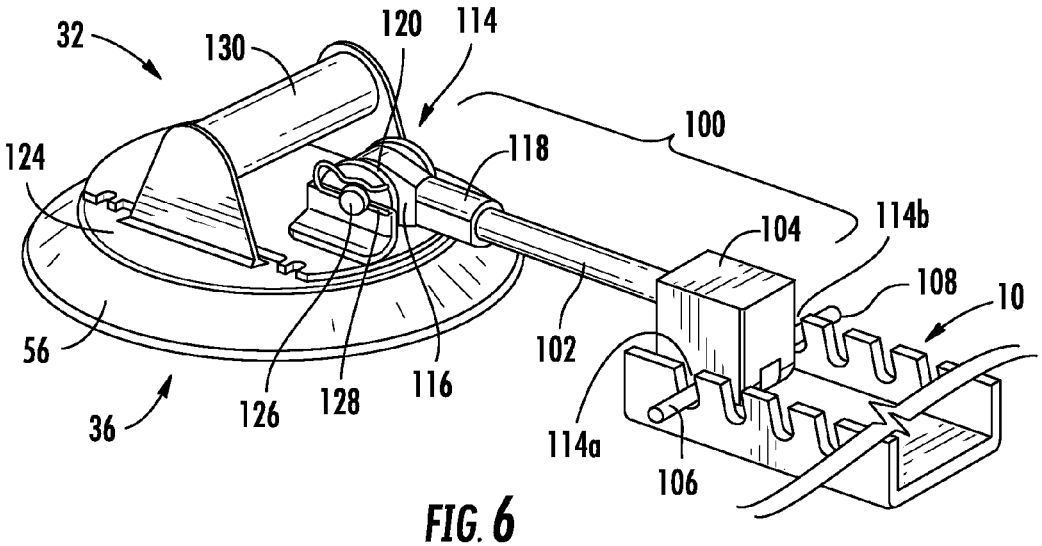
FIG. 6 shows a perspective view of another embodiment of the present inventive starter block and mounting device.

Preferably, this mechanism comprises a "ball joint" type of hinge 116 that enables rotational movement of the start block 10. An external thread on the end of the connector member 102 provides for threaded engagement of the connector member 102 with an internally threaded first end 118 of ball joint 116. The second end 120 of the ball joint 116 is received by spaced bracket members 122*a, b* disposed on the top surface of the suction device bracket assembly 124 mounted to the suction device 56. The ball joint 116 is secured in place with an axle 126 and fastener 128, such a cotter pin as seen in FIG. 6.

This feature allows the suction device 56 to be place on uneven surfaces offering independent movement relative to the starting blocks 10. This auto-leveling improves the adhesion of the suction device 56 when used on an uneven surface by allowing the starting blocks 10 to move independently of the suction device assembly 36. The multi-axial movement also allows the suction device 56 to potentially be placed on a non-porous wall if space behind the blocks 10 is limited. The range of motion also allows the starting blocks 10 to be lifted completely off of the floor in order to make alignment adjustment without disengaging the blocks 10 from the suction device assembly 36. This range of motion also eliminates the need for spacers to compensate for slight height differences between the suction device assembly 36 and the block 10. The ability to disengage the axial rotation mechanism 114 from the suction device assembly 36 enables the interface assembly 100 to remain in place on the starting block 10 even when the starting block anchor 32 is not in use.

The suction device bracket assembly 124 further comprises a gripping member 130, such as a handle, which provides for ease of gripping and moving the anchor 32. The interface assembly 100 can be easily separated from the suction device bracket assembly 124 by disengaging the fastener 128 and releasing the axle 126 from the bracket members 122*a, b*. Likewise, the axles 106, 108 can be readily released from slots 114*a, b* in the starting block 10. This provides for ease of transport and storage of anchor 32 and starting block 10.

Figure 10:
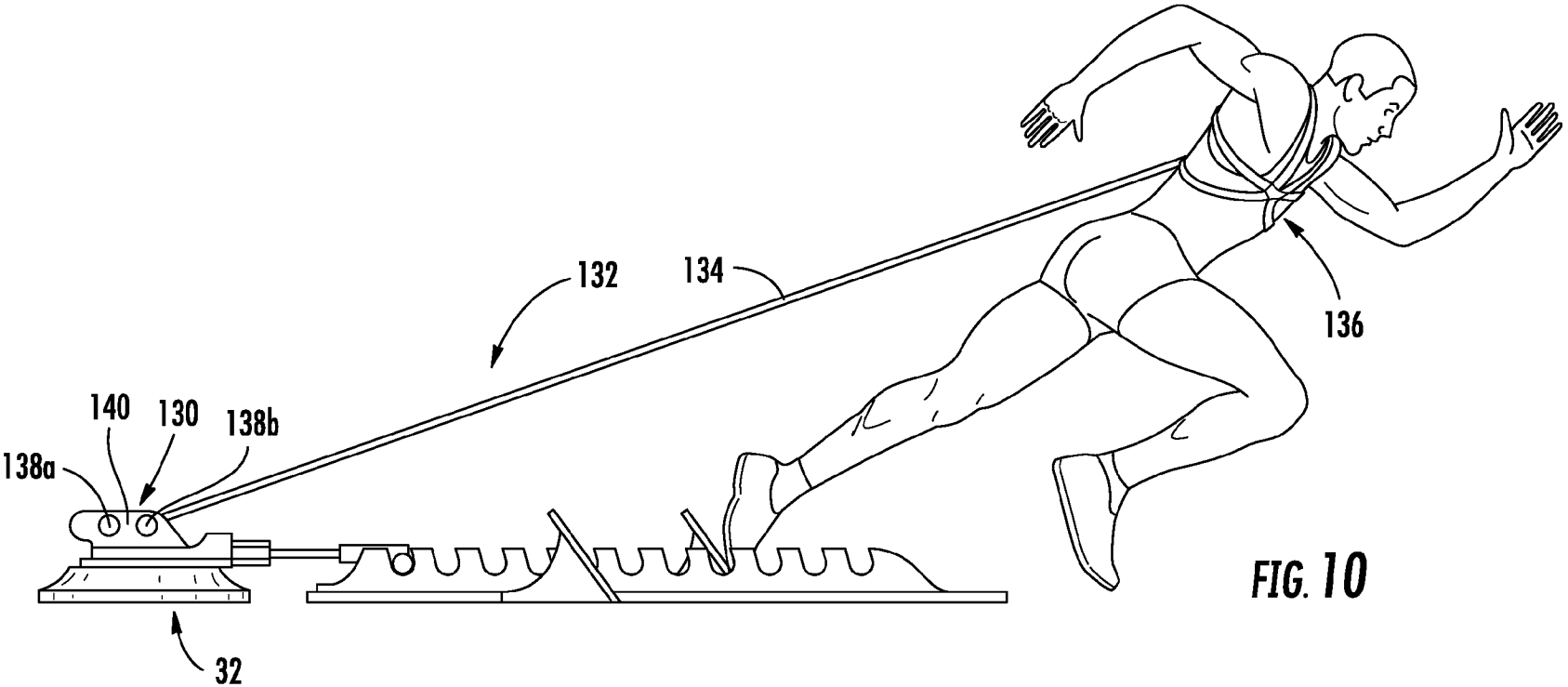
FIG. 10 shows a side elevation view of a feature of the present inventive starter block and mounting device.
Figure 11:
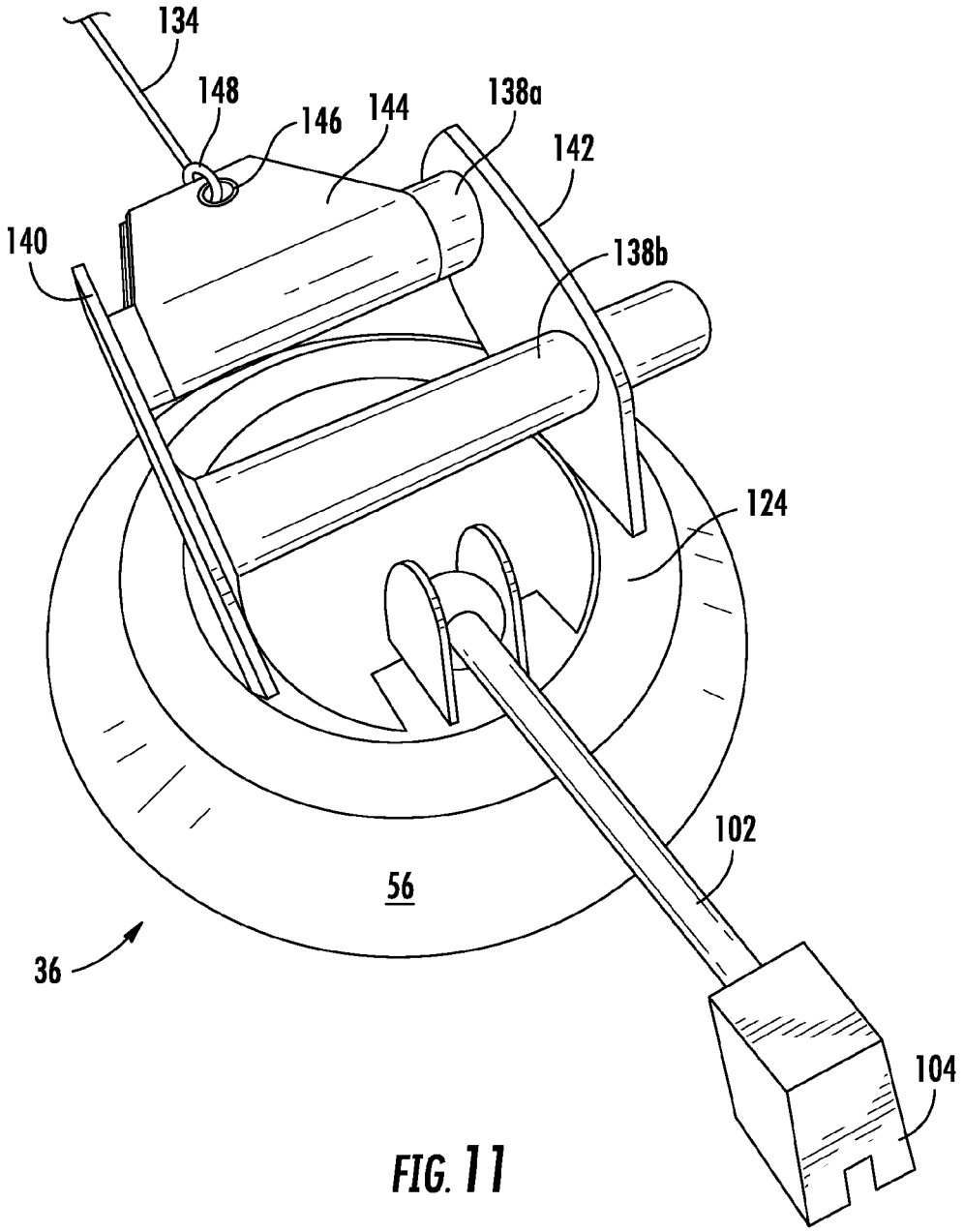
FIG. 11 shows a top plan view of a feature of the present inventive starter block and mounting device of FIG. 10.

FIGS. 10 and 11 show a feature of the present invention that can be incorporated the embodiments described herein. As seen in this figure, an anchor 130 is incorporated into the suction device bracket assembly 124. The anchor 130 provides a means for attachment of a resistance device 132 to the anchor 32. An elastic cord 134 attached at a first end to the anchor 130 and at a second end to a runner using the starting block 10 by way of a harness 136 comprises the resistance device 134 shown in FIG. 11. Any suitable resistance device can be substituted for the device described herein. The anchor 130 comprises a first and second rod or shaft 138*a*, 138*b* extending between a first and second spaced bracket member 140, 142. The first shaft 138*a* can also be the gripping member 130 described above. The second shaft 138*b* is disposed in front of the first shaft 138*a*, with respect to the position of the starting block 10, and is preferably disposed below the first shaft 138*a*. The cord 134 is clipped to a strap 144 at a first second grommet 146, (not seen), by a suitable connector 148, preferably a clip or carabineer-type connector. The strap 144 wraps around the first shaft 138*a*, locked in position by clipping the cord 134 to the strap 144. The cord 134 is intended to be wrapped under the second shaft 138*b* before extending towards the runner. In this manner, the forces applied by the cord 134 to the second shaft 138*b* are not immediately pulling the anchor 32 away from the surface on which it is mounted.

While the present invention has been described in connection with a specific application, this application is exemplary in nature and is not intended to be limiting on the possible applications of this invention. It will be understood that modifications and variations may be effected without departing from the spirit and scope of the present invention. It will be appreciated that the present disclosure is intended as an exemplification of the invention and is not intended to limit the invention to the specific embodiments illustrated and described. The disclosure is intended to cover, by the appended claims, all such modifications as fall within the scope of the claims.

I claim:

1. A track and field starting block anchor to anchor a starting block having a first and second spaced rail and a space therebetween to a surface, the track and field starting block anchor comprising:

a) a suction device assembly adapted to releasably and securely engage the surface to which the starting block anchor is to be anchored;

b) a stabilizing plate comprising a first portion comprising a horizontal stabilizing portion and a first and second vertical stabilizing portion forming a receiving channel, the first portion adapted to engage the starting block, and a second portion adapted to hingedly and readily detachably engage the suction device assembly; and c) a first locking assembly adapted to releasably secure the first portion of the stabilizing plate to the starting block and comprising a locking bar and a first fastener releasably connecting the locking bar to the stabilizing plate, wherein the first fastener is adapted to engage the starting block in the space between the first and second spaced rail to releasably secure the first portion of the stabilizing plate to the starting block.

2. The track and field starting block anchor of claim 1 wherein the track and field starting block anchor is releasably mounted to a starting block wherein the starting block is received by the receiving channel in the stabilizing plate and is secured to the stabilizing plate by the first locking assembly and wherein the first locking assembly engages the starting block in a space between the first and the second rail.

3. The track and field starting block anchor of claim 1 further comprising an interchangeable spacer disposed between the suction device assembly and the second portion of the stabilizing plate.

4. A track and field starting block anchor to anchor a starting block to a surface, the starting block anchor comprising:

a suction device assembly in direct rotatable communication with a stabilizing member, the suction device assembly adapted to releasably secure the starting block anchor to the surface; and the stabilizing member comprising: (a) a starting block engagement portion in releasable and direct engagement with the starting block, the starting block engagement portion comprising a head piece with a top surface and a first and a second sidewall extending from the top surface and a first starting block engagement axle extending from the first sidewall; and (b) a suction device assembly engagement portion in rotatable and direct engagement with the suction device assembly; and an axial rotation mechanism disposed between the suction device assembly and suction device engagement portion of the stabilizing member.

5. The track and field starting block anchor of claim 4 wherein the axial rotation mechanism connecting the suction device assembly and suction device engagement portion of the stabilizing member comprises a ball configured to be received by a socket on the suction device assembly to form a ball joint coupling the stabilizing member to the suction device assembly.

6. The track and field starting block anchor of claim 5 wherein the ball is releasably coupled with the socket by a cotter pin connecting to an axle extending through the ball and socket.

7. The track and field starting block anchor of claim 4 wherein the axial rotation mechanism comprises a hinge adapted to releasably couple the stabilizing member with the suction device assembly.

8. A track and field starting block anchor to anchor a starting block to a surface, the track and field starting block anchor comprising:

(a) a suction device assembly in direct rotatable communication with a stabilizing member, the suction device assembly adapted to releasably secure the starting block anchor to the surface;

(b) the stabilizing member comprising: a starting block engagement portion in releasable and direct engagement with the starting block, the starting block engagement portion comprising a head piece with a first and second starting block engagement axle extending from the head piece; and a suction device assembly engagement portion in rotatable and direct engagement with the suction device assembly; and (c) an axial rotation mechanism connecting the suction device assembly and suction device engagement portion of the stabilizing member and comprising a ball configured to be received by a socket on the suction device assembly to form a ball joint coupling the stabilizing member to the suction device assembly.

9. The track and field starting block anchor of claim 1 wherein the horizontal stabilizing portion of the stabilizing plate comprises a first bore adapted to receive the first locking assembly.

10. The track and field starting block anchor of claim 1 wherein the first fastener comprises an externally threaded winged member and the locking bar comprising an internally threaded bore, wherein the internal threads of the bore and external threads of the winged member correspond to facilitate threaded engagement of the winged member and locking bar.

11. The track and field starting block anchor of claim 4 wherein the starting block anchor is releasably mated to a starting block comprising a first rail, the first rail comprising a first sidewall with a plurality of notches, wherein the first starting block engagement axle is received by a first of the plurality of notches.

12. The track and field starting block anchor of claim 8 wherein the starting block anchor is releasably mated to a starting block comprising a first rail, the first rail comprising a first and second sidewall with a plurality of notches disposed at corresponding locations on each of the first and second sidewalls, wherein the first and second starting block engagement axles are received by opposing notches of the first and second sidewalls of the rail.

13. The starting block anchor of claim 4 further comprising a second starting block engagement axle extending from the second sidewall.

14. The starting block anchor of claim 13 wherein the first and second starting block engagement axles are axially aligned.

15. The track and field starting block anchor of claim 13 wherein the starting block anchor is releasably mated to a starting block comprising a first rail, the first rail comprising a first and second sidewall with a plurality of notches disposed at corresponding locations on each of the first and second sidewalls, wherein the first and second starting block engagement axles are received by opposing notches of the first and second sidewalls of the rail.

16. The track and field starting block anchor of claim 8 wherein the axial rotation mechanism connecting the suction device assembly and suction device engagement portion of the stabilizing member comprises a ball configured to be received by a socket on the suction device assembly to form a ball joint coupling the stabilizing member to the suction device assembly.

17. The track and field starting block anchor of claim 16 wherein the ball is releasably coupled with the socket by a cotter pin connecting to an axle extending through the ball and socket.

18. The starting block anchor of claim 8 wherein the first and second starting block engagement axles are axially aligned.

* * * * *